US012590507B1

(12) United States Patent
Clark et al.

(10) Patent No.: US 12,590,507 B1
(45) Date of Patent: Mar. 31, 2026

(54) WIRELINE-SET PLUG APPARATUS OPERABLE FOR HOLDING PRESSURE OR AS AN ESP CATCHER

(71) Applicant: Target Completions LLC, Broken Arrow, OK (US)

(72) Inventors: Joseph Clark, Lago Vista, TX (US); Michael Thomas Sommers, Broken Arrow, OK (US)

(73) Assignee: TARGET COMPLETIONS LLC, Broken Arrow, OK (US)

( * ) Notice: Subject to any disclaimer, the term of this patent is extended or adjusted under 35 U.S.C. 154(b) by 0 days.

(21) Appl. No.: 19/043,636

(22) Filed: Feb. 3, 2025

(51) Int. Cl.

| | |
|---|---|
| ***E21B 33/134*** | (2006.01) |
| ***E21B 33/12*** | (2006.01) |
| ***E21B 34/14*** | (2006.01) |
| ***E21B 40/00*** | (2006.01) |

(52) U.S. Cl.
CPC ..... *E21B 33/134* (2013.01); *E21B 33/12* (2013.01); *E21B 40/001* (2020.05); *E21B 34/14* (2013.01)

(58) Field of Classification Search
CPC ..... E21B 33/134; E21B 40/001
See application file for complete search history.

(56) References Cited

U.S. PATENT DOCUMENTS

| | | | | |
|---|---|---|---|---|
| 2,802,534 | A | 8/1957 | Conrad | |
| 3,082,824 | A * | 3/1963 | Taylor | E21B 33/1293 166/134 |
| 3,179,180 | A | 4/1965 | Hart | |
| 3,189,096 | A | 6/1965 | Phenix | |
| 3,664,417 | A | 5/1972 | Conrad | |
| 4,317,485 | A | 3/1982 | Ross | |
| 4,605,063 | A | 8/1986 | Ross | |
| 4,765,403 | A | 8/1988 | Crawford | |
| 5,197,547 | A * | 3/1993 | Morgan | E21B 23/06 166/387 |
| 5,327,975 | A | 7/1994 | Land | |
| 5,366,019 | A | 11/1994 | Brooks | |
| 5,771,969 | A | 6/1998 | Garay | |
| 9,890,603 | B2 | 2/2018 | Moore | |
| 12,031,411 | B1 | 7/2024 | Clark et al. | |
| 2010/0263876 | A1* | 10/2010 | Frazier | E21B 33/134 166/123 |
| 2014/0027127 | A1* | 1/2014 | Frazier | E21B 34/063 166/376 |
| 2015/0013996 | A1* | 1/2015 | Davies | E21B 19/10 166/134 |
| 2015/0285026 | A1* | 10/2015 | Frazier | E21B 33/128 166/120 |
| 2016/0138363 | A1* | 5/2016 | Sommers | E21B 33/1292 166/138 |

(Continued)

*Primary Examiner* — Neel Girish Patel
(74) *Attorney, Agent, or Firm* — Dennis D. Brown; Brown Patent Law, P.L.L.C.

(57) ABSTRACT

An assembly which includes (a) a plug apparatus having slips, an outer sealing element, and a pump-out plug which blocks internal flow through the apparatus for use as a bridge plug and (b) a wireline adapter kit having an adapter rod which screws into the pump-out plug to set the plug apparatus by wireline, wherein the adapter rod shears from the pump-out plug when the set pressure is reached, the plug apparatus is convertible to a flow-through catching plug by applying a pump-out pressure to the pump-out plug from above, and the plug apparatus is retrievable after use.

5 Claims, 6 Drawing Sheets

(56) References Cited

U.S. PATENT DOCUMENTS

| | | | | |
|---|---|---|---|---|
| 2017/0145776 | A1* | 5/2017 | Silva | E21B 33/134 |
| 2019/0032447 | A1* | 1/2019 | Wakefield | E21B 34/063 |
| 2019/0153815 | A1* | 5/2019 | Stone | E21B 34/10 |
| 2019/0186229 | A1 | 6/2019 | Hrupp | |
| 2020/0308921 | A1 | 10/2020 | Hrupp | |
| 2021/0047895 | A1* | 2/2021 | Sherman | E21B 29/02 |
| 2022/0120151 | A1* | 4/2022 | Jacob | E21B 33/124 |
| 2022/0228460 | A1* | 7/2022 | Goodman | E21B 33/13 |

* cited by examiner

WIRELINE-SET PLUG APPARATUS OPERABLE FOR HOLDING PRESSURE OR AS AN ESP CATCHER

FIELD OF THE INVENTION

The present invention relates to (a) downhole apparatuses for plugging wellbores for well pressure control and for catching electric submersible pumps (ESPs) and other equipment, (b) wireline setting methods for setting such apparatuses, and (c) well assemblies which include such apparatuses.

BACKGROUND OF THE INVENTION

A well tubing string assembly for an electric submersible pump (ESP) will typically comprise: an ESP tubing hanger; an ESP gas separator; an ESP (i.e., an electric submersible pump); a pump motor with an electric connection point; and an electric power cable which extends into the well from a wellhead having an ESP cable by-pass. The string assembly can also include pressure and temperature sensors, which are typically located at the lower end of the string.

Another tool which is sometimes included in the ESP assembly, either in or below the ESP string, is an ESP catcher. The catcher works to catch the pump and related ESP equipment in the event that the equipment falls in the well as a result, e.g., of a tubing failure. ESP catchers have the potential, for example, of being beneficial in horizontal completions to prevent the ESP equipment from falling out of the vertical portion of the well into a horizontal leg. If the ESP equipment is not retained in the vertical portion of the well, the fishing and retrieval operations for recovering the ESP equipment are much more difficult.

A need exists for an improved wireline apparatus which will operate both as a bridge plug for installing an ESP string and will then operate as an ESP catcher after the ESP string is installed. The combination plug and ESP catching apparatus will preferably: (a) be more compact than prior apparatuses; (b) provide pressure control below the ESP when operating as a plug during the ESP installation operation; (c) have an increased internal flow diameter, when operating as an ESP catcher after the installation operation, for increased flow of the well production fluid to the ESP; (d) create a high degree of setting force; (e) be operable using either an E-line setting tool or a hydraulic setting tool; and (f) be retrievable after use.

SUMMARY OF THE INVENTION

The present invention provides a plug apparatus, and a wireline setting method therefor, which address the needs identified above. The inventive plug apparatus can be used as a bridge plug for pressure control and/or as an ESP catching plug. The present invention also provides an ESP well assembly, and methods of installation and use, which include the inventive plug apparatus.

The inventive plug apparatus (a) can be set using either an E-line setting tool or a hydraulic setting tool, (b) is more compact (i.e., is only about 22 inches in length for a 4.044 to 5.044 inch ID well casing), (c) will provide pressure control below an ESP, when installing an ESP string, in the range of from about 7,000 to about 10,000 psi or more, (d) provides an increased internal flow diameter of as much as 3 inches or more, for a 4.044 to 5.044 inch ID well casing, when operating as an ESP catching plug after the ESP string is installed, (e) can create a setting force of as much as 45,000 pounds or as much as 50,000 pounds or more, and (f) is retrievable after use without fishing.

The inventive combination plug and catching tool also eliminates the need for a snubbing unit when installing the ESP system. An E-line unit can be used, for example, to install the inventive plug apparatus so that a standard workover rig can be used to install the ESP system, with no special pressure control equipment required at the surface.

In one aspect, there is provided an assembly for use in a well which preferably comprises a plug apparatus and a wireline adapter assembly. The plug apparatus preferably comprises: (i) an inner mandrel having a longitudinal axis and a flow channel which extends longitudinally through the inner mandrel, (ii) a plurality of slips positioned around the inner mandrel, (iii) one or more cone structures positioned around the inner mandrel, (iv) a sealing element positioned around the inner mandrel, and (v) a pump-out plug element held in the flow channel by a plurality of shear screws or shear pins. The pump-out plug element is downwardly removable through the flow channel by applying a pump-out pressure to an upper end of the pump-out plug element which shears the shear screws or shear pins. The pump-out plug element also has an upper cavity which extends into the upper end of the pump-out plug element, the upper cavity of the pump-out plug element having threads formed therein.

The wireline adapter assembly preferably comprises an adapter rod having exterior threads formed on a lower end portion thereof. The lower end portion of the adapter rod is threadedly received in the upper cavity of the pump-out plug element of the plug apparatus and the plug apparatus is settable in the well by applying a setting force via the wireline adapter assembly to the plug apparatus which will bring the one or more cone structures into engagement with the slips and will set the sealing element in a sealing position.

In another aspect, there is provided a plug apparatus for use in a well which preferably comprises: (i) an inner mandrel having a longitudinal axis and a flow channel which extends longitudinally through the inner mandrel, (ii) a plurality of slips positioned around the inner mandrel, (iii) one or more cone structures positioned around the inner mandrel, (iv) a sealing element positioned around the inner mandrel, (v) a pump-out plug element held in the flow channel by a plurality of shear screws or shear pins, the pump-out plug element being downwardly removable through the flow channel by applying a pump-out pressure to an upper end of the pump-out plug element which shears the shear screws or shear pins, (vi) a lower collet structure integrally formed on a lower end of the inner mandrel, the lower collet structure having exterior threads, (vii) the lower collet structure of the inner mandrel being threadedly received in a control sleeve of the plug apparatus, and (vii) the plug apparatus also having a release sleeve. Preferably, the release sleeve (a) is inserted in a lower end of the flow channel of the inner mandrel, (b) has an upper end which abuts an interior shoulder of the lower collet structure of the inner mandrel, and (c) has a lower end portion which is secured to a lower end portion of the control sleeve by a plurality of shear screws or shear pins.

In another aspect, there is provided a method for use in a wellbore which comprises a step (a) of running an assembly into a wellbore on a wireline, wherein the assembly comprises a plug apparatus and a wireline adapter assembly for attaching the plug apparatus to the wireline. The plug apparatus preferably comprises: (1) an inner mandrel having a longitudinal axis and a flow channel which extends longitudinally through the inner mandrel, (2) a plurality of slips positioned around the inner mandrel, (3) one or more cone structures positioned around the inner mandrel, (4) a sealing element positioned around the inner mandrel, (5) a pump-out plug element held in the flow channel by a plurality of shear screws or shear pins, and (6) the pump-out plug element having an upper cavity which extends into an upper end of the pump-out plug element, the upper cavity of the pump-out plug element having threads formed therein.

The wireline adapter assembly used in this method is operable for applying a setting force to the plug apparatus and can comprise an adapter rod having exterior threads formed on a lower end portion thereof. The lower end portion of the adapter rod is preferably threadedly received in the upper cavity of the pump-out plug element of the apparatus. The adapter rod also preferably has a setting force shear point at which the adapter rod shears from the upper cavity of the pump-out plug element.

The method also preferably comprises the steps of: (b) setting the plug apparatus and plugging the wellbore by applying the setting force via the wireline adapter assembly to the plug apparatus which brings the one or more cone structures into engagement with the slips and sets the sealing element against an interior wall or a casing in the wellbore and (c) disconnecting the wireline adapter assembly from the plug apparatus by applying the setting force in step (b) until the setting force shear point is reached so that the adapter rod shears from the upper cavity of the pump-out plug element.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
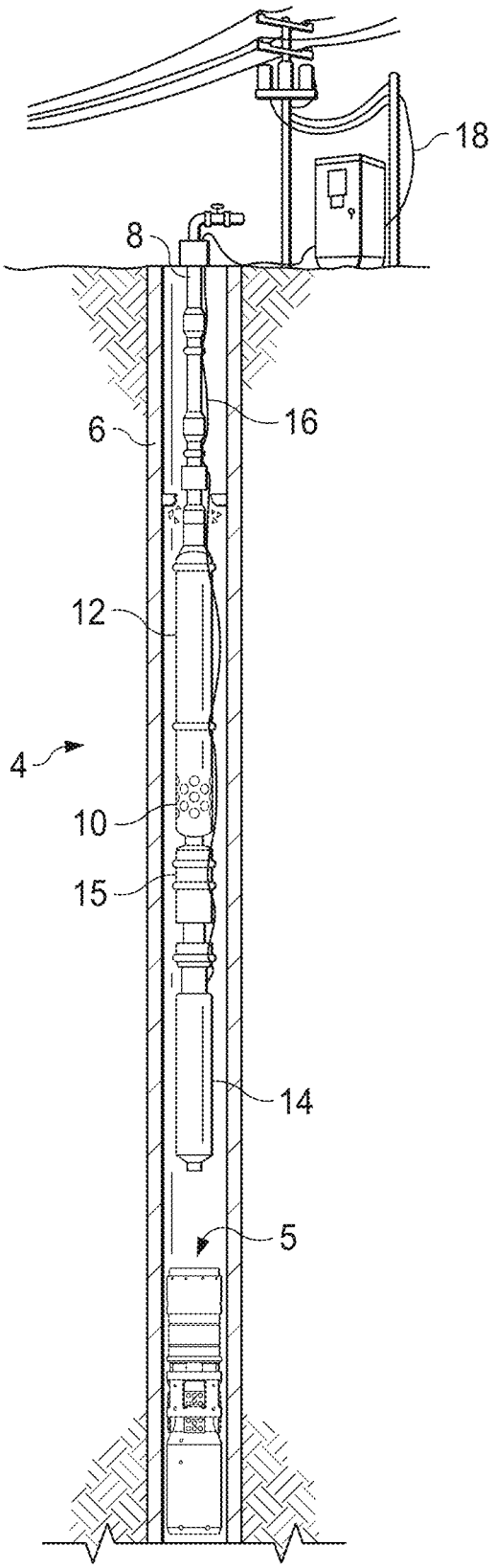
FIG. 1 schematically illustrates an embodiment 2 of an ESP string assembly provided by the present invention.
Figure 4:
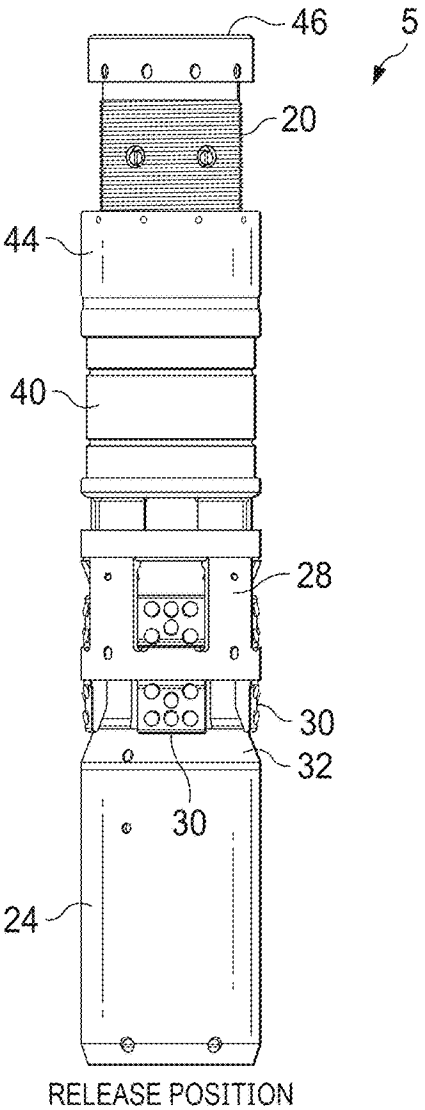
FIG. 4 is another elevational view of the inventive plug apparatus 5 shown in a release position for retrieving the inventive plug apparatus 5 from the well.
Figure 3:
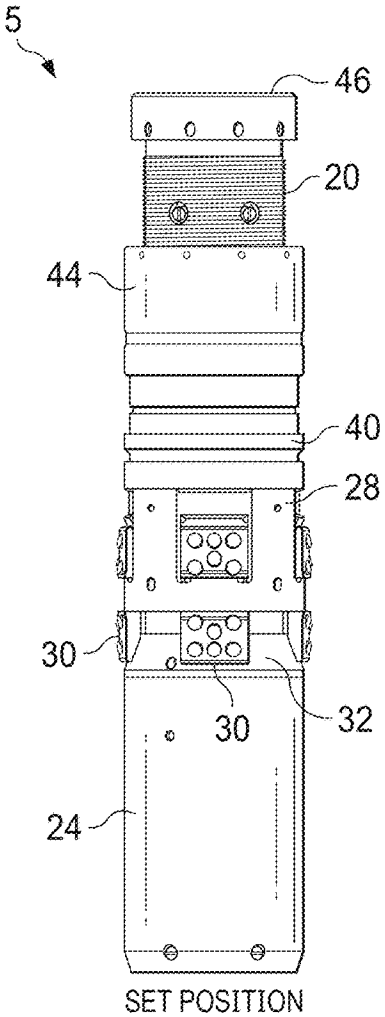
FIG. 3 is another elevational view of the inventive plug apparatus 5 shown in a set position for setting in a well.
Figure 2:
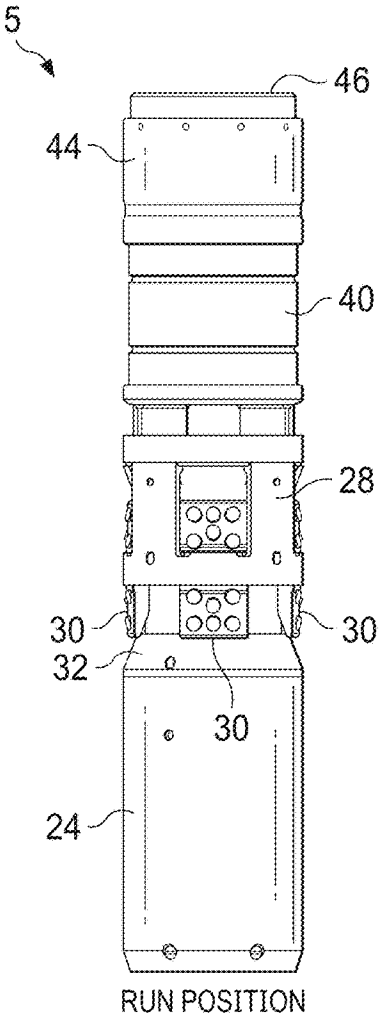
FIG. 2 is an elevational view of an embodiment 5 of the inventive plug apparatus provided by the present invention, wherein the inventive plug apparatus 5 is shown in FIG. 2 in a run-in position.
Figure 5:
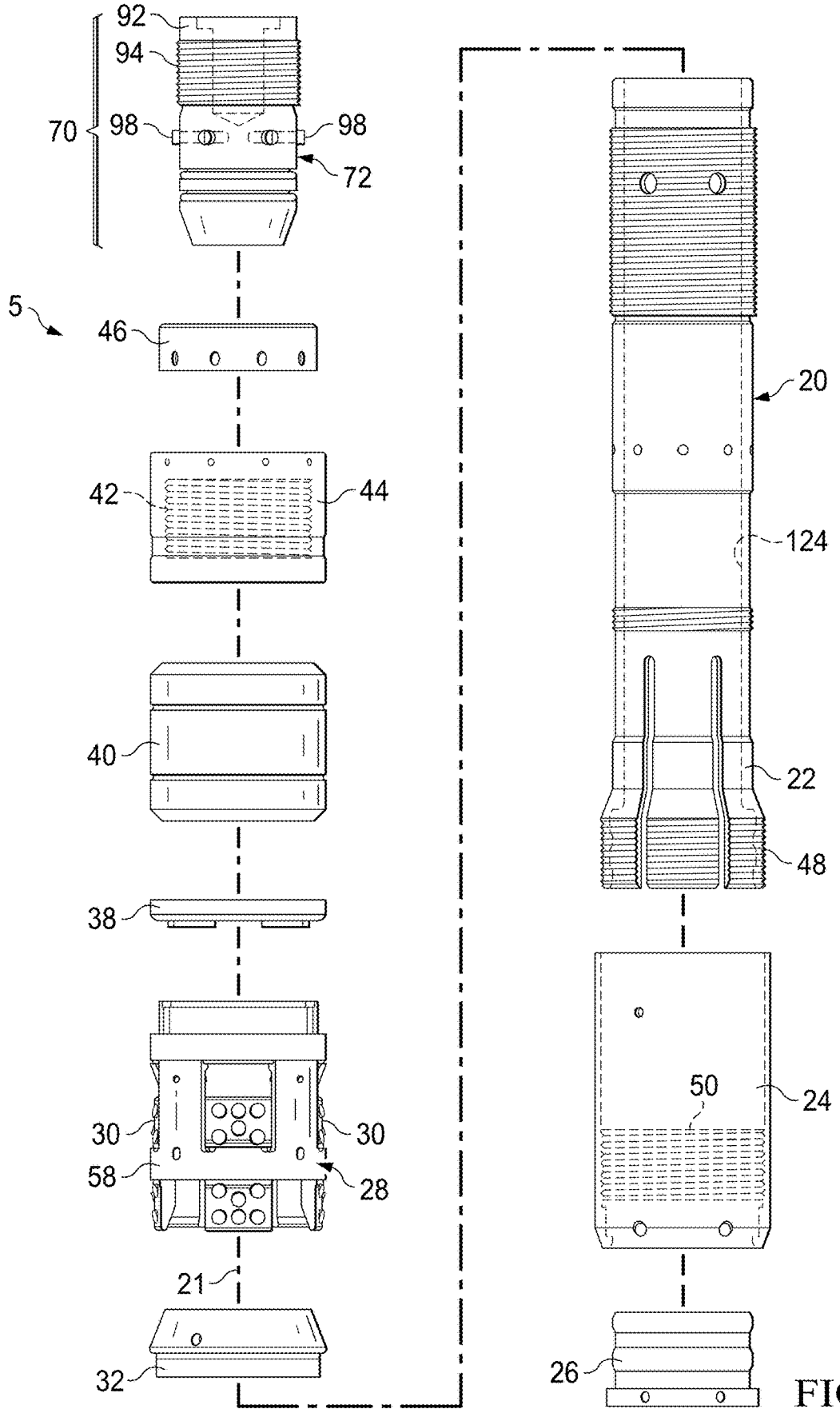
FIG. 5 is a cutaway exploded view of the inventive plug apparatus 5.
Figure 6:
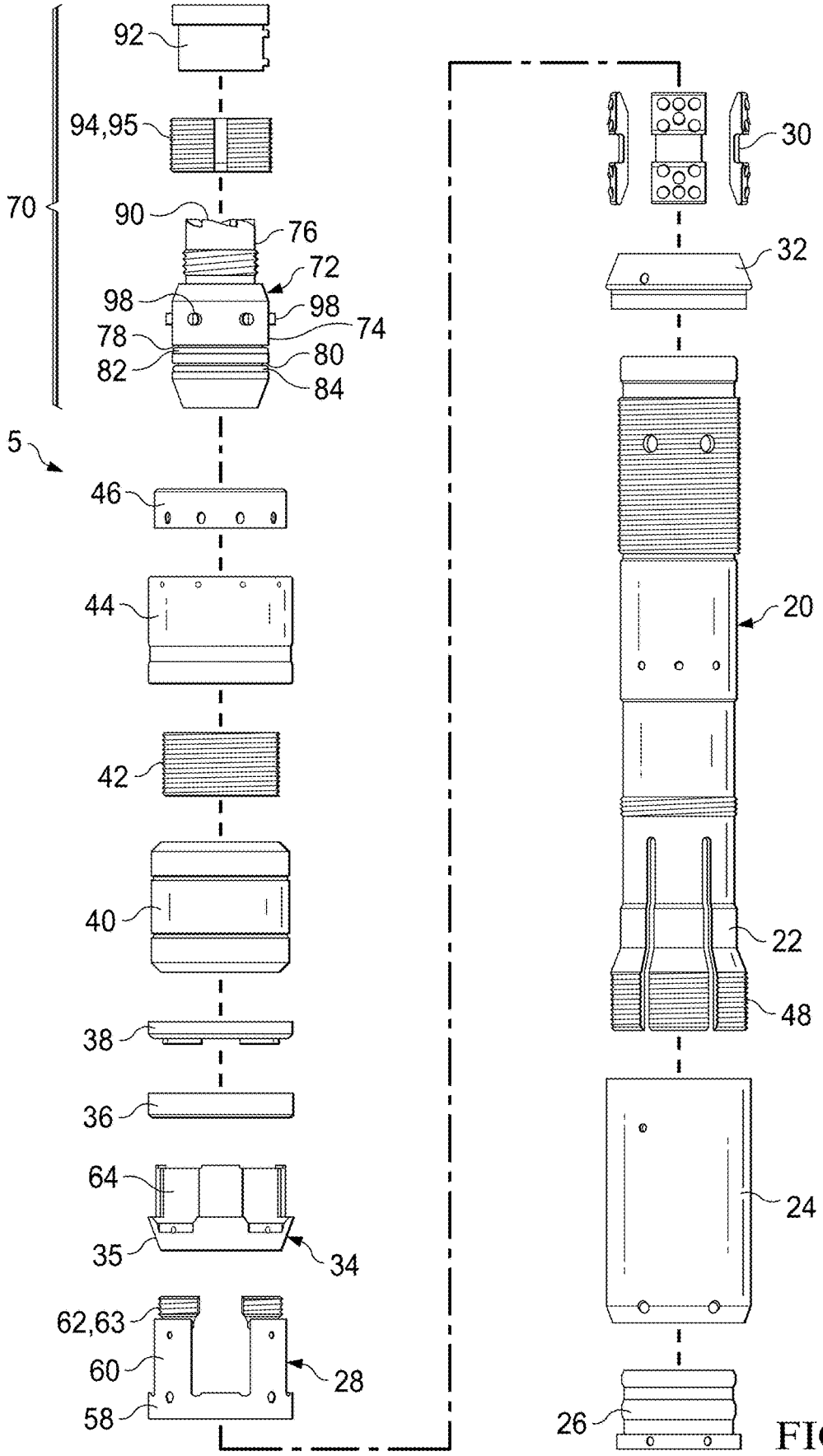
FIG. 6 is another exploded view of the inventive plug apparatus 5.

An embodiment 2 of the downhole ESP assembly provided by the present invention is illustrated in FIG. 1. The inventive downhole assembly 2 comprises (i) an ESP string 4 and (ii) an embodiment 5 of the inventive plug apparatus which is positioned in the well 6 below the ESP string 4.

The ESP string 4 can extend from generally any type of well tubing string 8. The ESP string 4 preferably comprises: a gas separator 10; an electric submersible pump (ESP) 12; a pump motor 14 below the pump 12; a seal section (protector) 15 between the ESP 12 and the pump motor 14; and an electric power cable 16 which extends from an above-ground power source 18 to the pump motor 14.

The wellbore 6 will typically have a casing therein. However, it will be understood that the inventive downhole ESP assembly 2 can alternatively be installed in an uncased well or an uncased portion of a well. In addition, it will also be understood that: (i) some of the elements shown in the ESP string 4 of FIG. 1 can optionally be excluded, (ii) temperature sensors, pressure sensors, and/or other sensors or components can optionally be added to the ESP string 4, and (iii) the inventive plug apparatus 5 can also be used in other types of downhole systems and assemblies which do not include ESPs.

As used herein and in the claims, terms such as up and down, top and bottom, above and below, upward and downward, upwardly and downwardly, and upper and lower merely refer to the orientation of the inventive ESP string 4 and the inventive plug apparatus 5 when positioned in a vertical portion of the well 6.

The term "about", when used herein and in the claims in reference to a length or distance or pressure, means ±5%.

As shown in FIGS. 2-7, the embodiment 5 of the plug apparatus provide by the present invention preferably comprises: an inner collet mandrel 20 having a longitudinal axis 21 and a collet structure 22 formed on the lower end of the inner mandrel 20; a release control sleeve 24; a release sleeve 26 (also referred to as a gizmo sleeve); a slip body 28; a plurality of bi-directional slips 30; a lower slip cone 32; an upper slip cone structure 34; a slip body gauge ring 36; a lower gauge ring 38; an outer sealing element 40; a lock nut 42; a lock nut housing 44; and a top cap 46.

To assemble the inventive plug apparatus 5 in a "run-in" configuration (FIG. 2) for delivery into the well 6, the lower collet end 22 of the inner mandrel 20 is delivered into the upper end of the release control sleeve 24 and the exterior ratchet threads 48 formed around the lower collet end 22 of the mandrel 20 are screwed into the interior threads 50 formed in the lower portion of the release control sleeve 24. However, rather than fully tightening the threaded connection, the collet threads 48 are preferably screwed into the interior threads 50 of the release control sleeve 24 to a point sufficient to leave a gap 51 of from about. 12 to about. 16 inch between (a) the lower end of the inner mandrel 20 and (b) an interior shoulder 52 of the release control sleeve 24 formed adjacent the lower end thereof. The gizmo (release) sleeve 26 is then inserted into the lower end of the release control sleeve 24 and is secured within the lower end of the release control sleeve by a plurality of radially inserted gizmo shear screws 54.

The inclusion of the collet structure 22 on the lower end on the inner mandrel 20 and the use of bi-directional slips 30 reduces the length of the inventive plug apparatus 5 by about 12 inches. The use of the inner mandrel 20 in the inventive plug apparatus 5 having a collet structure 22 formed on the lower end thereof as an integral part of the inner mandrel 20 is also beneficial in that it eliminates the need for additional parts and also helps to reduce the length of the plug apparatus 5.

In addition, the location of the outer sealing element 40 near the top of the inventive plug apparatus 5 prevents debris from entering and building up between the body of the tool 5 and the casing or internal wall of the wellbore 6.

With the gizmo sleeve 26 and the lower collet end 22 of the inner mandrel 20 installed in the release control sleeve 24, the lower slip cone 32 is delivered downwardly around the exterior of the inner mandrel 20 and is screwed into the upper end of the control sleeve 24. As will be discussed more fully below, the gizmo sleeve 26 will operate during the retrieval of the inventive plug apparatus 5 to assist in transitioning the plug apparatus 5 from the set position shown in FIG. 3 to the release and retrieval position shown in FIG. 4. The gizmo sleeve 26 also operates in the inventive tool 5 to release the force on the threads of the collet 22 and the control sleeve 24, which allows the mandrel 20 to move upwardly and release the slips 30.

With the lower slip cone 32 in place, a slip assembly is formed and delivered downwardly around the inner mandrel 20. The slip assembly comprises: the slips 30; a corresponding number of slip springs 56; the slip body 28; the upper cone structure 34; and the slip body gauge ring 36. The longitudinally extending, bi-directional slips 30 are retained by a lower collar 58 of the slip body 28 which laterally surrounds the inner mandrel 20 and surrounds the longitudinal mid-portions of the slips 30. The slip springs 56 are positioned between the slips 30 and the lower collar 58 of the slip body 28 to continuously bias the slips 30 inwardly toward the inner mandrel 20 and away from engagement with the cased or uncased wellbore 6.

The slip body 28 further comprises a plurality of collet legs 60 which extend upwardly from the lower collar 58 and include inwardly extending snap structures 62 on the upper ends thereof. The snap structures 62 snap over the upper cone 35 of the upper cone structure 34 and are received in longitudinal slots 64 of the upper cone structure 34 which extend upwardly from the upper cone 35. External threads 63 are formed around the upper snap structures 62 of the upper cone structure 34 for threadedly receiving the slip body gauge ring 36.

The slip assembly is secured in place on the inner mandrel 20, immediately above the lower slip cone 32, by a plurality of radially inserted shear screws which extend through both the upwardly extending collet legs 60 of the slip body 58 and the upper cone structure 34.

The lower gauge ring 38 is then delivered downwardly around the inner mandrel 20. The lower gauge ring 38 is a clutched gage ring which interlocks with the slip body and the upper cone.

The clutched gauge ring 38, the upper cone structure 34, and the slip body 28 are made of cast iron or other mill-able material and therefore form a unique slip body assembly that is fully drillable in the event, e.g., that an attempt to retrieve the inventive plug apparatus 5 after use is not successful. All of the upper components of the plug apparatus 5 are preferably clutched.

The lower gauge ring 38 is followed by the outer sealing element 40. The lower gauge ring 38 operates to receive the lower end of the outer sealing element 40 and to (i) back up the sealing element 40 when setting and (ii) help retain the sealing element 40.

The outer sealing element 40 will preferably be formed of Hydrogenated Nitrile Butadiene Rubber (HNBR) such as Ecner HNBR, or Ecner Aflas™ or Nitrile.

After the addition of the outer the sealing element 40, the lock nut housing 44, having the lock nut 42 positioned therein, is received downwardly around the upper end portion of the inner mandrel 20. The lock nut housing assembly is ratcheted onto the mandrel 20 by pushing the plug 72, discussed below, into the top of the plug apparatus 5 to the point that the shear elements can be installed and until the lower end of the lock nut housing 44 receives the upper end of the outer sealing element 40. The lock nut 42 operates to hold the pump-out plug 72 (i) while setting the plug apparatus 5 and (ii) until the plug 72 is pumped out. The lock nut housing 44 operates to (a) retain the upper end of the outer sealing element 40 for compression during setting and (b) hold the locknut 94 for the ratchet head 42 on the top of the mandrel 20 to thereby lock the top of the mandrel 20. This locks the plug apparatus 5 after setting.

Finally, the top cap (also referred to as the mandrel cap) 46 is screwed onto the upper end of the inner mandrel 20. A plurality of retention screws 68 are inserted radially through the lock nut housing 44 and into the top cap 46 for retaining the pump-out plug 72. The top cap 46 holds the shear screws 98 until the pump-out plug 72 is pumped out of the plug apparatus 5.

In order to facilitate the wireline setting procedure, and to allow the inventive plug apparatus 5 to operate as a bridge plug during the installation of the ESP string 4 (or during other operations), an inner pump-out plug assembly 70 is installed in the upper end of the inner flow channel 124 of the inner mandrel 20 of the inventive plug apparatus 5 prior to running the apparatus 5 into the well 6.

The inner pump-out plug assembly 70 comprises an inner pump-out plug element 72 which is receivable in the upper end of the inner mandrel 20, through the top cap 46. The pump-out plug element 72 is preferably configured to include: (i) a wider lower body portion 74 which fits tightly within the inner mandrel 20, (ii) a narrower upper body portion 76, (iii) a pair of seal grooves 78 and 80 formed around the lower body portion 74 for receiving a pair of O-ring seals 82 and 84, (iv) a bore hole 86 (or other cylindrical cavity or segmented cylindrical cavity) which extends downwardly into the upper end of the upper body portion 76 of the pump-out plug element 72, the cavity 86 having internal threads 88 therein, and (v) an upwardly projecting ratchet tooth profile 90 formed, at the upper end of the upper body portion 76 of the pump-out plug element 72, around the upper opening of the bore hole/cavity 86.

The inner pump-out plug element 72 will preferably be formed of a material which can hold pressure from below the plug 72 and is strong enough to shear off at over 40,000 pounds to set the plug apparatus 5. Examples of suitable materials include, but are not limited to, aluminum, magnesium, cast iron, or steel alloys.

The inner pump-out plug assembly 70 further comprises: (a) a support cap 92 which fits within the upper end of the inner mandrel 20 and within the mandrel cap 46, and is positioned around the upper end of the upper body portion 76 of the pump-out plug element 72; (b) a ratchet ring 94 having external ratchet threads 95 which are threadedly received within the upper end of the inner mandrel 20, the ratchet ring 94 being positioned around the support cap 92 of the pump-out plug element 72; (c) a plurality of screws which extend radially through the support cap 92 to the upper body portion 76 of the pump-out plug element 72; and (d) a plurality of pump-out plug shear screws or pins 98 which extend radially through the lock nut housing 44 and the inner mandrel 20 into the lower body portion 74 of the pump-out plug element 72.

The ratchet threads 95 of the ratchet ring 94 are preferably threaded downwardly into the inner mandrel 20 until the upper end of the pump-out plug element 72 is flush with the upper end of the mandrel cap 46. The ratchet threads 95 of the ratchet ring 94 operate to prevent the plug assembly 70 from being pulled upwardly out of the inner mandrel 20 during the setting operation. The support cap 92 of the pump-out plug element 72 traps the lock nut 94 on the pump-out plug 72.

Figure 7:
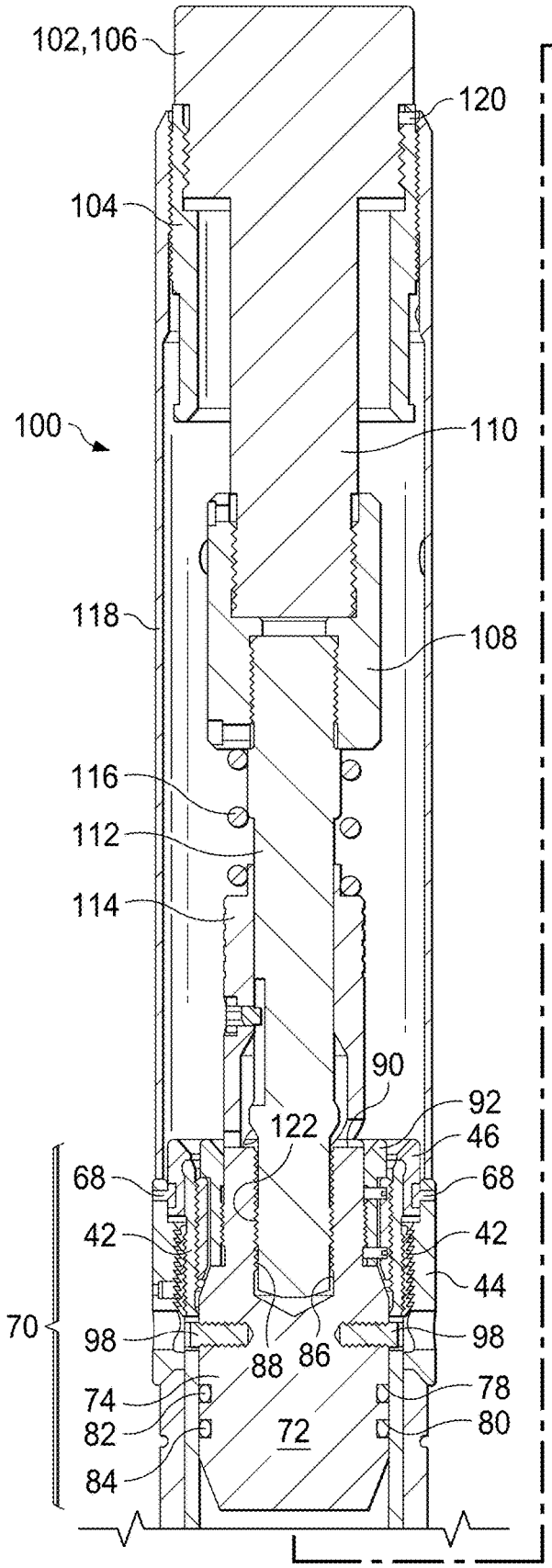
FIG. 7 is a cutaway elevational view of an embodiment 99 of the assembly provided by the present invention comprising the inventive plug apparatus 5 and a wireline adapter kit 100.
Figure 7:
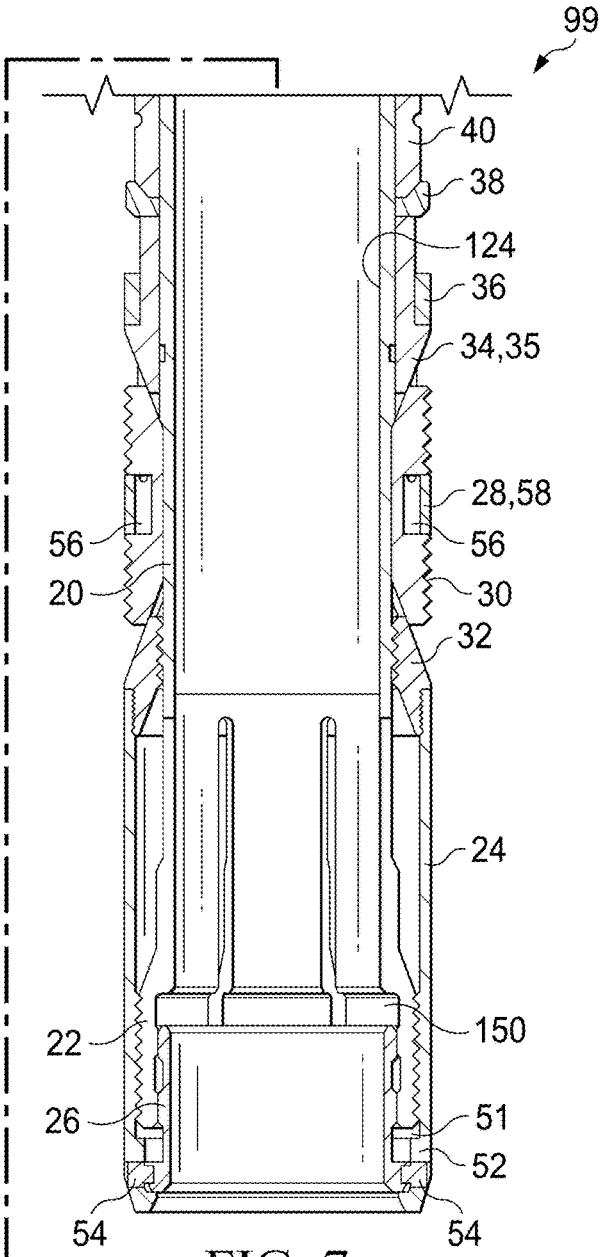

An assembly 99 comprising (i) the inventive plug apparatus 5 and (ii) a wireline adapter kit 100 for running the inventive plug apparatus 5 into the well 6, and then setting the plug apparatus 5 in the well 6, is illustrated in FIG. 7. The adapter kit 100 is secured on a charge pressure activated setting gun 102 on the lower end of the wireline. The charge pressure-activated setting gun 102 expands the chamber of the setting tool 102 and strokes the wireline adapter kit 100 to set the plug apparatus 5.

The wireline adapter kit 100 preferably comprises: (i) an outer adapter connector 104 which is secured on and extends downwardly from a wider upper end portion 106 of the setting gun 102; (ii) an inner adapter connector 108 which is secured on and extends downwardly from a narrower lower portion 110 of the setting gun 102; (iii) an inner adapter rod 112 having an upper end which is secured in, and which extends downwardly from, the inner adapter connector 108; (iv) a clutch housing 114 which is positioned around a lower end portion of the inner adapter rod 112; (v) a compression spring 116 which is positioned around the inner adapter rod 112 between the inner adapter connector 108 and the clutch housing 114 for continuously urging the clutch housing 114 downwardly; and (vi) a setting sleeve 118 which is threadedly secured around, and extends downwardly from, the outer adapter 104.

A plurality of radial set screws 120 will preferably be used to secure the setting sleeve 118 on the outer adapter connector 104. The setting sleeve 118 surrounds the outer adapter 104, the setting gun 102, the inner adapter 108, the inner adapter rod 112, the clutch housing 114, and the compression spring 116, and extends over at least most of the longitudinal length of the adapter kit 100.

External shear threads 122 are formed around the lower end portion of the inner adapter rod 112. Before running the inventive plug apparatus 5 into the well 6, the threads 122 on the lower end of the inner adapter rod 112 are used to screw the lower end portion of the inner adapter rod 112 into the threaded borehole (or other internally threaded cavity) 86 which extends into the upper end of the pump-out plug element 72, preferably until the lower end of the inner adapter rod 112 is fully received, or bottoms out, in the plug cavity 86. This also brings the lower end of the clutch housing 114 into operative engagement with the ratchet profile 90 on the upper end of the pump-out plug element 72 so that the clutch prevents the inner adapter rod 112 from unscrewing from the plug element 72 as the inventive plug apparatus 5 is delivered into the well 6.

With the inner adapter rod 112 screwed into the upper end of the pump-out plug element 72, the setting sleeve 118 is preferably moved downwardly on the outer adapter connector 104 to a run-in position in which the lower end of the setting sleeve 118 abuts the upper end of the lock nut housing 44. The sleeve set screws 120 are then tightened to hold the setting sleeve 118 in the run-in position.

When the inventive plug apparatus 5 is lowered to a desired location in the well 6 by the wireline system, the wireline is then used to set the plug apparatus 5 in the well 6 by firing a charge to stroke the plug apparatus 5. This pulls the inner adapter 112 while the setting sleeve 118 holds the plug apparatus 5. The lock nut 42 and the lock nut housing 44 are thereby forced downward to set the slips 30 and to set the sealing element 40 of the plug apparatus 5.

This causes the pump-out plug assembly 70 to pull the inner collet mandrel 20 of the plug apparatus 5 upwardly in the apparatus 5, which in turn pulls the release control sleeve 24 upwardly to simultaneously activate the bi-directional slips 30 and the outer sealing element 40 by (1) pulling the lower slip cone 32 upwardly under the lower gripping sections of the slips 30 to push the lower gripping portions of the slips 30 outwardly into engagement with the casing or wall of the wellbore 6, (2) pulling the upper gripping sections of the slips 30 upwardly over the upper slip cone 35 to push the upper gripping portions of the slips 30 outwardly into engagement with the casing or wall of the wellbore 6, and (3) pulling the lower gauge ring 38 upwardly to pack off (set) the outer sealing element 40 by compressing the outer sealing element 40 of the inventive plug apparatus 5 into outward sealing engagement with the casing or wall of the wellbore 6.

The wireline system will then continue to pull upwardly on the pump-out plug assembly 70 and the inner mandrel 20 until the shear threads 122 on the lower end of the inner adapter rod 112 are sheared and the inner adapter rod 112 is thereby freed from the pump-out plug element 72. Depending, e.g., on the number of flights of the shear threads 122 on the lower end of the inner adapter rod 112, the inner adapter rod 112 will typically not be released from the plug element 72 until from about 40,000 to about 50,000 pounds of setting force have been applied to the inventive plug apparatus 5 by the wireline system. During this process, the ratchet threads 95 of the pump-out plug assembly ratchet ring 94 operate to (a) prevent the pump-out plug assembly 70 from being pulled upwardly out of the inner mandrel 5 and (b) lock the setting force in place.

As alternatives to the charge pressure activated setting gun 102, it will be understood that other wireline devices could instead be used to set the inventive plug apparatus 5. Examples of other suitable wireline setting devices include, but are not limited to, hydraulic setting tools or a Baker-Style #20 setting tool.

Once the inventive plug apparatus 5 is set in the well, and with the pump-out plug assembly 70 still in place to block flow through the inner flow channel 124 of the plug apparatus 5, the inventive plug apparatus 5 will operate as a bridge plug to hold upward pressure in the well 6 (i.e., to hold pressure from below the plug apparatus 5) while the ESP string 4 is installed in the well. Depending upon the type and rating of the outer sealing element 40 of the plug apparatus 5, the inventive plug apparatus 5 will hold an amount of upward pressure in the well 6 from below the plug apparatus 5 in the range of from about 7,000 psi to about 10,000 psi or more.

After the ESP string 4 is installed and the wellhead is flanged-up for operation, the inventive plug apparatus 5 can be converted from a bridge plug to a flow-through catching plug by pumping down the well 6 to produce a pump-out pressure above the inventive plug apparatus 5 which is sufficient to shear the shear screws or pins 98 of the internal pump-out plug element 72. Once the screws or pins 98 are sheared, the pump-out plug element 72 is forced downwardly through the interior flow channel 124 and out of the lower end of the inventive plug apparatus 5. The amount of pump-out pressure required to pump-out the internal pump-out plug element 72 can be predetermined and set based upon the number and rating of the pump-out plug shear screws or shear pins 98 used.

With the pump-out plug element 72 removed, in a 4.660 to 4.778 ID well casing, the flow ID of the interior flow channel 124 of the inventive plug apparatus 5 will typically be as much as 3 inches or more, thus providing a significantly greater rate of flow of the well production fluid to the ESP 12 than is permitted by other ESP catching tools.

In the method of the present invention, the wireline adapter kit 100 is installed on the end of a wireline and used to run the inventive plug apparatus 5 into the well 6 by screwing the lower end of inner adapter rod 108 of the wireline adapter kit 100 into the upper threaded cavity 86 of the pump-out plug element 72. The resulting assembly 99, which comprises the inventive plug apparatus 5 and the wireline adapter kit 100, is illustrated in FIG. 7.

When the assembly 99 is run into the well 6 to the location desired, a setting force is applied to the inventive plug apparatus 5, via the wireline adapter kit 100, by stroking the wireline adapter kit 100 and setting the apparatus 5. The setting force pulls the inner mandrel 20 and the release control sleeve 24 of the plug apparatus 5 upwardly such that (i) the lower slip cone 32 is pulled upwardly beneath the lower gripping portions of the slips 30 to push the lower gripping portions into engagement with the inner wall or casing of the wellbore 6, (ii) the upper gripping portions of the slips 30 are pulled upwardly over the upper slip cone 35 to push the upper gripping portions into engagement with the inner wall or casing of the wellbore 6, and (iii) the lower gage ring 38 pushes the lower end of the outer sealing element 40 upwardly to compress the outer sealing element 40 into sealing engagement with the inner wall or casing of the wellbore 6.

Next, the ultimate desired setting force is imparted to the slips 30 and the outer sealing element 40 by continuing to apply the setting force to the inventive plug apparatus 5 until the setting force shear point of the threads 122 of the inner adapter rod 112 of the wireline adapter kit 100 is reached. At the setting force shear point, the inner adapter rod 112 shears from the upper cavity 86 of the pump-out plug element 72 and the wireline and wireline adapter kit 100 are thereby released.

Once the inventive plug apparatus 5 is set in the well 6, it will hold pressure from below while the ESP string 4 or other equipment is installed in the well 6 above the plug apparatus 5.

After the ESP string 4 or other equipment is installed in the well 6 above the plug apparatus 5, a pump-out pressure will preferably be produced in the well 6, above the plug apparatus 5, for application to the upper end of the pump-out plug element 72. The pump-out pressure will be a pressure which is sufficient to shear the shear screws or shear pins 98 of the pump-out plug element 72 and force the plug element 72 downwardly through the inner flow channel 124 of the inner mandrel 20 and out of the lower end of the inventive plug apparatus 5.

With the pump-out plug element 72 removed, the inventive plug apparatus 5 will operate as a catching device for the ESP 12 or other equipment positioned above the catching apparatus 5, while at the same time providing enhanced production flow to the ESP 12 or other system.

Figure 8:
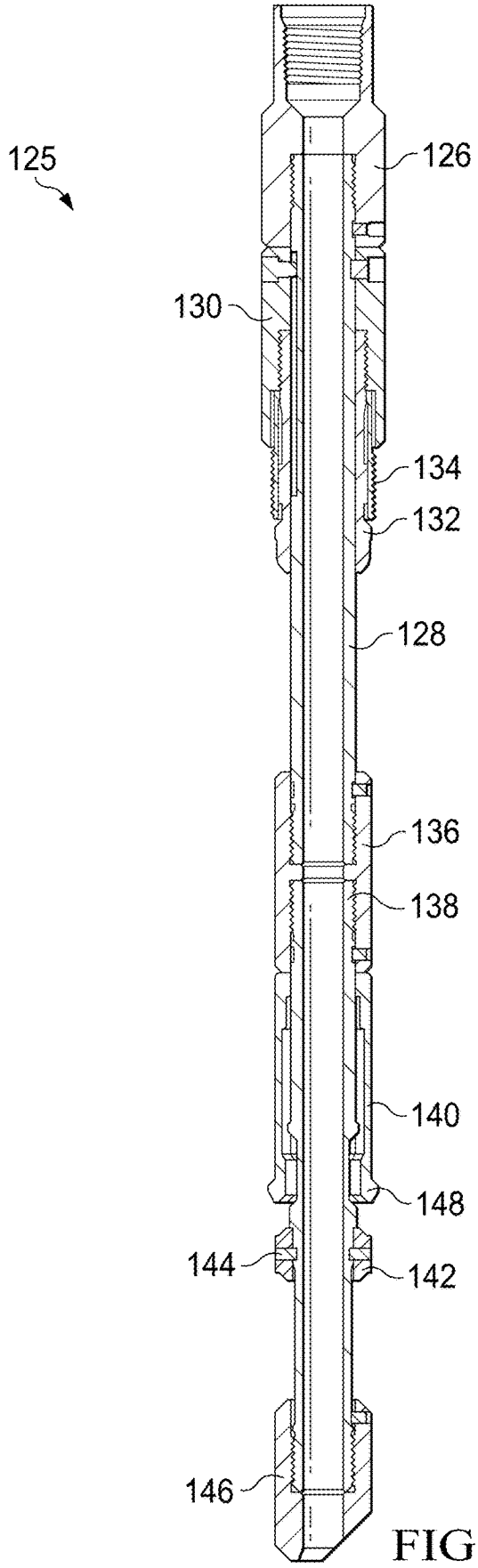
FIG. 8 is an elevational view of an embodiment 125 of a retrieving tool provided by the present invention.

When the ESP string 4 is removed from the wellbore 6, the inventive plug apparatus 5 can then also be removed from the well 6 using the retrieving tool 125 illustrated in FIG. 8. The retrieving tool 125 preferably comprises: (i) a top sub 126 which can be secured on the lower end of a tubing string; (ii) an upper mandrel segment 128 which extends downwardly from the top sub 126; (iii) a control sleeve 130 which is positioned around the upper mandrel segment 128 and extends downwardly from the top sub 126; (iv) a threaded latch mandrel 132 and a collet 134 which are positioned around the upper mandrel segment 128 and extend downwardly from the control sleeve 130; (v) a center coupling 136 which is positioned on and extends downwardly from the lower end portion of the upper mandrel segment 128; (vi) a lower mandrel segment 138 which is secured by and extends downwardly from the center coupling 136; (vii) a release collet 140 which is positioned around the lower mandrel segment 138 and extends downwardly from the center coupling 136; (viii) a collet shear release ring 142 which is positioned around the lower mandrel segment 138 below the lower end of the release collet 140; (ix) a plurality of shear screws 144 which retain the collet shear release ring 142 in position on the lower mandrel segment 138; and (x) a mule shoe 146 on the lower end of the lower mandrel segment 138.

In the retrieval operation, the retrieving tool 125 is delivered downhole such that mule shoe 146 on the lower end of the retrieval tool 125 guides the tool 125 into the inner flow channel 124 of the inventive plug apparatus 5. The retrieving tool 125 is then lowered further so that the mule shoe 146 travels out of the bottom of the plug apparatus 5 and the radially projecting collet tabs 148 on the lower end of the release collet 140 snap out of the lower end of the gizmo (release) sleeve 26.

The retrieving tool 125 is then pulled upwardly so that the collet tabs 148 contact and are stopped by the bottom of the gizmo sleeve 26. Then, as the retrieving tool 125 continues to be pulled upwardly, the lower mandrel segment 138 is pulled upwardly through the release collet 140 such that collet shear release ring 142 is received beneath the lower end of the release collet 140 and urges the collet tabs 148 radially outward into tighter engagement with the bottom of the gizmo sleeve 26.

Initially, as the retrieving tool 125 pulls the gizmo sleeve 26 upward, the gizmo sleeve simultaneously (a) pushes upwardly against the release control sleeve 24 of the of the plug apparatus 5 via the shear screws 54 which attach the gizmo sleeve 26 to the release control sleeve 24 and (b) pushes upwardly against an interior shoulder 150 of the inner collet mandrel 20 of the plug apparatus 5. Consequently, initially, there is no separation between the release control sleeve 24 and the inner collet mandrel 20.

However, as the retrieving tool 125 continues to pull the gizmo sleeve upwardly, the shear screws 54 of the gizmo sleeve 26 are sheared so that gizmo sleeve 26 then pulls the inner mandrel 20 upwardly inside the release control sleeve 24. This in turn relaxes the tension between the slips 30 and the upper and lower slip cones 35 and 32 of the plug apparatus 5, and also relaxes the outer sealing element 40, so that the plug apparatus 5 moves to the release mode illustrated in FIG. 4 and can be lifted by the retrieving tool 125 out of the well 6.

However, if the retrieving tool 125 is unable to shear the shear screws 148 of the gizmo sleeve 26, the collet 148 will move down to retrieve the apparatus 5. If the apparatus 5 will not move, the shear pins 144 will shear and allow the collet release ring 142 to move down, thereby releasing the collet 148 from the plug apparatus 5.

The top section of the inventive plug apparatus 5 is formed of cast iron or other mill-able material. This includes the lock nut housing 44, the lower gauge ring 38, the upper slip cone structure 34, the slip body 28, and the slips 30.

Thus, the present invention is well adapted to carry out the objectives and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. An apparatus for use in a well comprising:

an inner mandrel having a longitudinal axis and a flow channel which extends longitudinally through the inner mandrel, a plurality of slips positioned around the inner mandrel, one or more cone structures positioned around the inner mandrel, a sealing element positioned around the inner mandrel, a pump-out plug element held in the flow channel by a plurality of shear screws and/or shear pins, the pump-out plug element being downwardly removable through the flow channel by applying a pump-out pressure to an upper end of the pump-out plug element which shears the shear screws and/or shear pins, a lower collet structure integrally formed on a lower end of the inner mandrel, the lower collet structure having exterior threads, the lower collet structure of the inner mandrel being threadedly received in a control sleeve, and a release sleeve of the apparatus which (i) is inserted in a lower end of the flow channel of the inner mandrel, (ii) has an upper end which abuts an interior shoulder of the lower collet structure of the inner mandrel, and (iii) has a lower end portion which is secured to a lower end portion of the control sleeve by a plurality of shear screws and/or shear pins.

2. The apparatus of claim 1 further comprising:

the slips being bi-directional slips which each have an upper gripping portion and a lower gripping portion, and the one or more cone structures comprising (i) a lower cone structure which engages the lower gripping portions of the bi-directional slips and (ii) an upper cone structure which engages the upper gripping portions of the bi-directional slips.

3. An apparatus for use in a well comprising:

an inner mandrel having a longitudinal axis and a flow channel which extends longitudinally through the inner mandrel, a plurality of slips positioned around the inner mandrel, one or more cone structures positioned around the inner mandrel, a sealing element positioned around the inner mandrel, a pump-out plug element held in the flow channel by a plurality of shear screws and/or shear pins, the pump-out plug element being downwardly removable through the flow channel by applying a pump-out pressure to an upper end of the pump-out plug element which shears the shear screws and/or shear pins, a lower collet structure integrally formed on a lower end of the inner mandrel, the lower collet structure having exterior threads, the lower collet structure of the inner mandrel being threadedly received in a control sleeve, a wireline adapter assembly comprising an adapter rod, a lower end portion of the adapter rod being threadedly received in an upper cavity of the pump-out plug element and the apparatus being settable in the well by applying a setting force via the wireline adapter assembly which brings the one or more cone structures into engagement with the slips and sets the sealing element in a sealing position.

4. The apparatus of claim 3 further comprising the inner mandrel moving upwardly within the slips, within the one or more cone structures, and within the sealing element when the setting force is applied via the wireline adapter assembly.

5. The apparatus of claim 3 further comprising the adapter rod having a setting force shear point and, when the setting force applied via the wireline adapter assembly reaches the setting force shear point, the adapter rod will shear from the upper cavity of the pump-out plug element.

* * * * *